US006601841B1

(12) United States Patent
Werner

(10) Patent No.: US 6,601,841 B1
(45) Date of Patent: Aug. 5, 2003

(54) STRAIGHT THROUGH OR NINETY DEGREE TURN HIGH CAPACITY FEEDER

(76) Inventor: Todd C. Werner, 3050 Alton Dr., St. Pete Beach, FL (US) 33706

( * ) Notice: Subject to any disclaimer, the term of this patent is extended or adjusted under 35 U.S.C. 154(b) by 0 days.

(21) Appl. No.: 10/065,072

(22) Filed: Sep. 13, 2002

(51) Int. Cl.[7] ..... B65H 5/22
(52) U.S. Cl. ..... 271/3.01; 271/146; 271/241
(58) Field of Search ..... 271/146, 3.01, 271/3.03, 3.05, 241, 220, 221, 225, 184

(56) References Cited

U.S. PATENT DOCUMENTS 3,705,719 A * 12/1972 Polit et al. ..... 271/3.03
3,776,544 A * 12/1973 Watson et al. ..... 271/3.03
4,081,181 A * 3/1978 Crowe et al. ..... 271/3.01

* cited by examiner

*Primary Examiner*—Christopher P. Ellis
*Assistant Examiner*—Richard Ridley
(74) *Attorney, Agent, or Firm*—Ronald E. Smith; Smith & Hopen, P.A.

(57) ABSTRACT

A feeder is rotatably mounted in cooperative relation to a discharge end of a conveyor system. In a first position, the feeder is in line with the conveyor system so that the path of travel of conveyed articles is not changed. In a second position, the feeder device is disposed at a right angle to the conveyor system so that the path of travel of conveyed articles is changed by ninety degrees. An adjustable length conveyor belt enables the discharge of conveyed articles into the feeder at differing positions, depending upon the size of the articles. A pair of upstanding walls having sloped edges reciprocates as the feeder operates to ensure that all articles are in shingled relation to one another so that the articles are fed into the feeder one at a time in the substantial absence of jamming.

3 Claims, 7 Drawing Sheets

STRAIGHT THROUGH OR NINETY DEGREE TURN HIGH CAPACITY FEEDER

BACKGROUND OF INVENTION

1. Field of the Invention

This invention relates, generally, to high capacity feeders. More particularly, it relates to a feeder positioned at the discharge end of a conveyor that is adapted to enable a a straight through path of travel in the direction of travel of articles carried by the conveyor or to enable a ninety degree change in said direction of travel.

2. Description of the Prior Art

When redirection of articles carried by a first conveyor belt is required, the conventional method is to position the trailing (receiving) end of a second conveyor belt at the leading (discharge) end of the first conveyor belt and to position the second conveyor belt at the desired angle relative to the first conveyor belt.

This procedure requires a second conveyor belt and substantial downtime as the second conveyor belt is positioned in cooperating relation to the first conveyor belt.

There are times when articles carried by the first belt need to be redirected to their original, straight through direction, thereby necessitating the removal of the second conveyor belt and restoring the system to its initial configuration.

When requirements for a change in direction are frequently followed by requirements for the initial configuration, a considerable amount of time is spent with the repeated addition and removal of the second conveyor belt.

What is needed, then, is a means for quickly redirecting conveyed articles from a first direction to a second direction and back to the first direction as frequently as required in the substantial absence of prolonged downtime during the changeover from one arrangement to another.

Conventional conveyor belts have a fixed length. However, applications sometimes require that a belt be lengthened or shortened by a relatively small amount such as a foot or a few feet. The conventional solution to this problem is to install a longer or shorter conveyor belt as needed. Such obvious solution consumes time and money. Specifically, such solution requires ownership of at least two conveyor belts of differing lengths. Each belt uses space when not being used.

What is needed is a conveyor belt construction that enables a conveyor belt to be lengthened or shortened in a brief amount of time. Such an adjustable length conveyor belt would not have the limitations of the prior art belts.

Yet another problem associated with feeders is their tendency to malfunction if the articles being fed thereinto are not perfectly shingled with respect to one another. For example, if envelopes are being fed into a feeder and an edge of an envelope juts out from the stack of envelopes, it will not be able to pass through the feeder and a jam will occur. This causes downtime and the concomitant loss of productivity. Accordingly, a human operator must continually monitor the articles being feed into the feeder and straighten them into a properly shingled stack on a frequent basis.

Thus, there is a need for an automated means that would maintain the articles being fed into the feeder in a properly aligned, shingled stack so that no articles jut out from the stack as said articles enter into a feeder.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for a feeder that can be quickly redirected between a straight through configuration or a ninety degree turn is now met by a new, useful, and nonobvious invention. The novel feeder capable of redirecting the path of travel of an article as said article is discharged from a conveyor means includes a conveyor system adapted to carry articles along a first path of travel and a rotatably mounted feeder positioned at a discharge end of the conveyor system. The rotatably mounted feeder is adapted to receive articles as they are sequentially discharged from the discharge end of the conveyor system.

The rotatably mounted feeder has a first position in line with the first path of travel so that articles adapted to be carried by the conveyor system along said first path of travel continue to follow said first path of travel upon being discharged by the conveyor system and entering into the feeder. This is the "straight through" configuration of the feeder.

The rotatably mounted feeder has a second position at a right angle to the first path of travel so that articles adapted to be carried by the conveyor system along the first path of travel are redirected into a second path of travel that is disposed at a ninety degree angle relative to the first path of travel upon being discharged by the conveyor system.

The novel feeder thereby eliminates the need for a second conveyor system to accomplish redirected travel. Moreover, the time required to re-configure the redirecting device from the first position to the second position is nominal.

A locking means selectively locks the redirecting device into the first and second positions.

When a plurality of rectangular articles such as envelopes are carried by a conveyor system, they may be positioned atop a conveyor belt in a longitudinal or transverse position. When longitudinally disposed, the longitudinal axis of an envelope is parallel to a longitudinal axis of the conveyor belt means. When transversely disposed, the longitudinal axis of the envelope is positioned at a ninety degree angle relative to the longitudinal axis of the conveyor belt means.

Accordingly, longitudinally disposed articles occupy a greater longitudinal extent of a conveyor belt means than the same number of transversely disposed articles of the same size. An operator therefore can spend less time loading the belt when rectangular articles are transversely disposed atop the conveyor belt means.

It may be advantageous to feed transversely disposed articles straight through the feeder and to feed longitudinally disposed articles at a right angle to the conveyor belt means. Such re-positioning of the feeder may require that the conveyor belt be lengthened or shortened. A need to change the length of the conveyor may also arise not as a function of the longitudinal or transverse positioning of the envelopes or other articles being fed into a feeder but as a function of the size of the article alone. Thus, if a first plurality of transversely disposed envelopes of a first width are followed by a second plurality of transversely disposed envelopes of a different width, the conveyor belt may require lengthening or shortening at the end of the first plurality.

The novel adjustable length conveyor means includes a table having a leading, discharge end and a trailing, loading end. A fixed position trailing roller means is positioned at a trailing end of the table. A leading roller means has an extended position remote from the leading end of the table and a retracted position proximal to the leading end of the table. A primary roller means has a fixed position that is between the trailing roller means and the leading roller means. A secondary roller means has an extended position remote from the primary roller means and a retracted position proximal to the primary roller means.

The extended position and the retracted position of the secondary roller means is between the leading roller means and the primary roller means.

A conveyor belt has a path of travel that extends from the trailing roller means, atop the table to the leading roller means, and below the table to the primary roller means. It then wraps around the primary roller means and extends to the secondary roller means. It wraps around the secondary roller means and returns to the trailing roller means.

The path of travel of the conveyor belt that extends atop the table from the trailing roller means to the leading roller means has a first length when the secondary roller means is in its retracted position and the leading roller means is in its extended position. The path of travel of the conveyor belt that extends atop the table has a second length when the secondary roller means is in its extended position and the leading roller means is in its retracted position. The first length exceeds the second length so that an article transported by the conveyor belt travels a first distance atop the table when the secondary roller means is in its retracted position and the leading roller means is in its extended position and so that an article transported by the conveyor belt travels a second distance less than said first distance when the secondary roller means is in its extended position and the leading roller means is in its retracted position.

Significantly, an operator may adjust the position of the leading roller and the secondary roller easily in a short amount of time. The leading and secondary rollers need not be fully extended or fully retracted but may be positioned at any number of operable positions between their fully extended and retracted positions. To prevent slack from appearing in the conveyor belt, an adjustment of one of the movable rollers must be matched by an equal but opposite adjustment of the other movable rollers. For example, if the leading roller is retracted three inches, the secondary roller must be extended three inches.

High capacity feeders often jam because the articles fed through them are stacked imperfectly, often with an edge of an article jutting from the stack or articles. Such an imperfectly aligned article may appear every few articles. This problem is addressed by providing a vibrating device that bears against the articles as they enter the feeder. The vibrations are of relatively high frequency so that the friction force between contiguous articles in a stack of articles is broken. In this way, an edge that may be jutting out is brought into alignment with the other articles in the stack because substantial removal of the friction force allows the misaligned article to feed into an alignment area with substantially no resistance offered between contiguous articles. Thus, each article flows or slides easily with respect to its contiguous articles because of the vibrations and alignment takes place. The vibrating means includes a wall tilted at an angle that imparts shingling to the articles so that they exit a hopper area of the feeder one at a time.

An important object of this invention is to provide a rotatably mounted high capacity feeder that is positionable at the discharge end of a conveyor system.

A closely related object is to provide a feeder that is quickly and easily re-configured to enable articles carried by a conveyor belt to change directions.

A more specific object is to provide a feeder that changes a path of travel of conveyed articles from a longitudinal path of travel to a transverse path of travel.

Another important object is to provide an adjustable length conveyor belt.

A closely related object is to provide a conveyor belt that does the work of a plurality of belts of differing lengths.

Another object is to provide an adjustable length conveyor belt that can be adjusted in length in a short period of time to minimize downtime.

Still another object is to provide a means for aligning misaligned articles into shingled relation to one another as they enter into a feeder.

These and other important objects, advantages, and features of the invention will become clear as this description-.proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
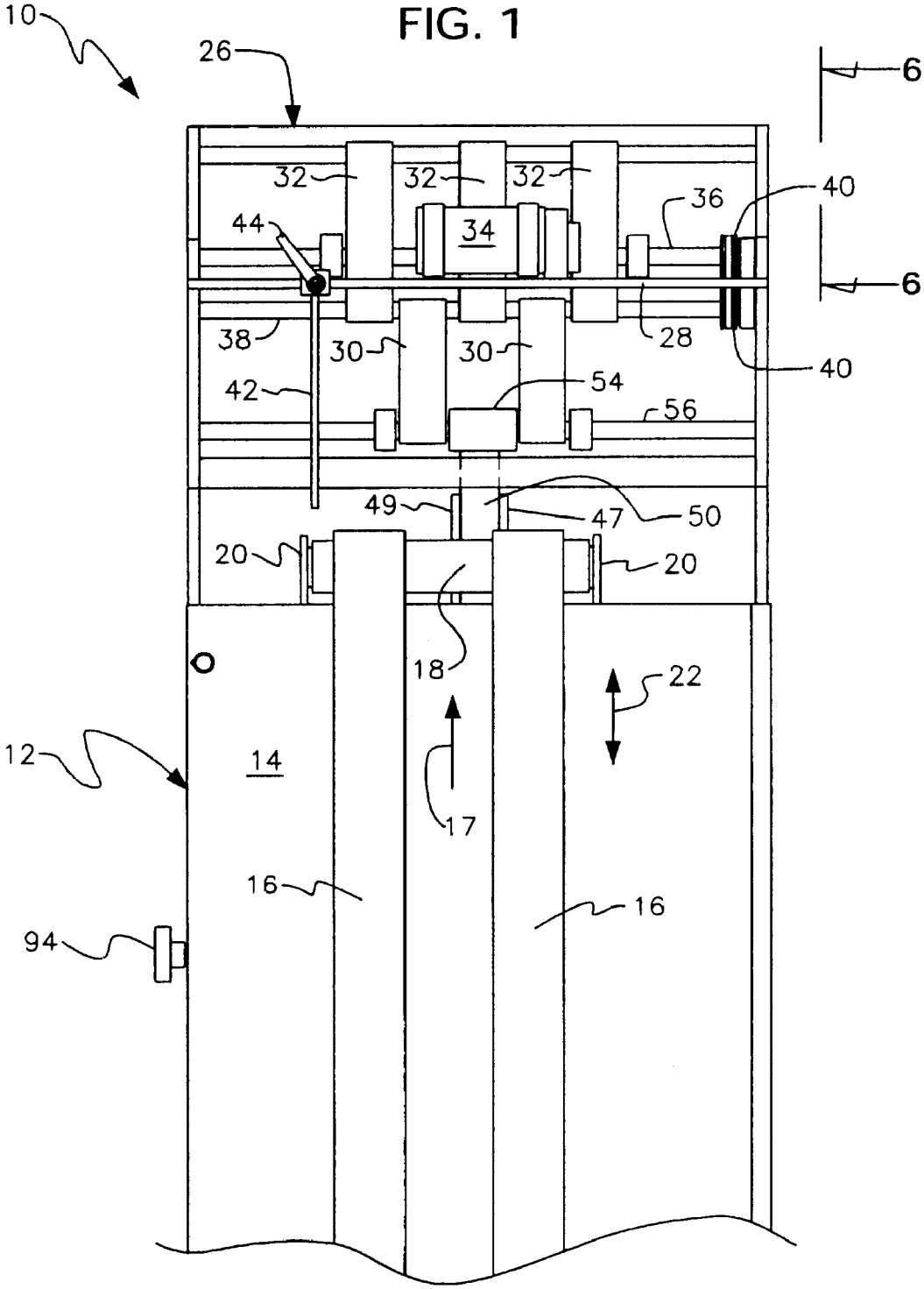
FIG. 1 is a top plan view depicting a first configuration of the novel direction-changing feeder.
Figure 2:
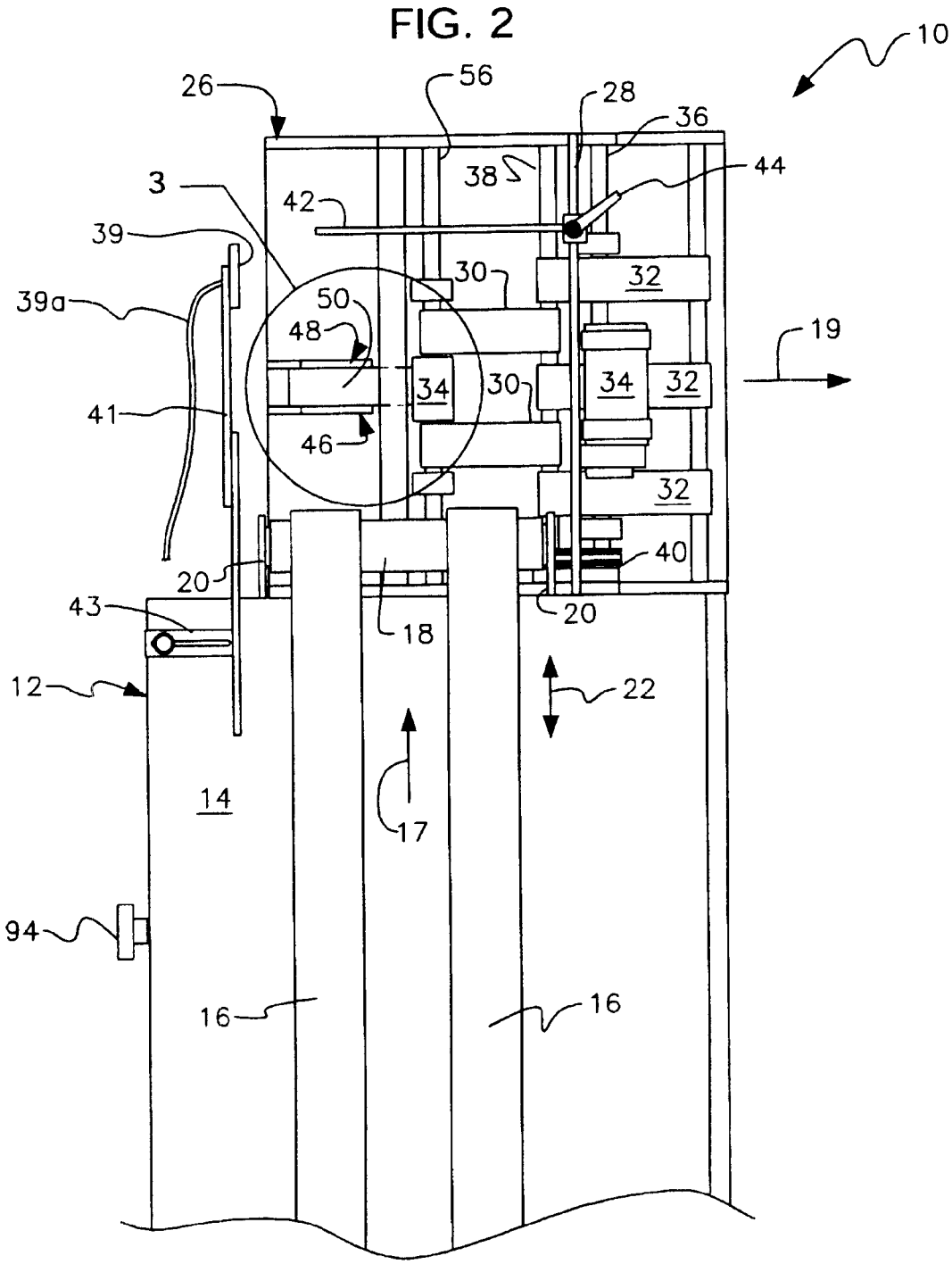
FIG. 2 is a top plan view depicting a second configuration thereof.
Figure 3:
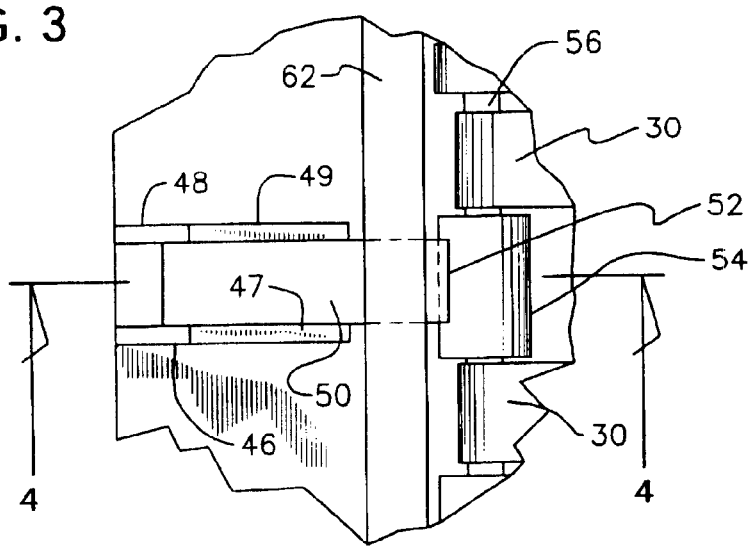
FIG. 3 is an enlarged view of the circled parts denoted 3 in FIG. 1.

Referring to FIGS. 1–3, it will there be seen that the reference numeral 10 denotes an illustrative embodiment of novel apparatus 10 as a whole.

Conveyor means 12 includes table 14 and a pair of parallel belts, collectively denoted 16. The leading or discharge end of each belt wraps around a roller 18. Roller 18 is mounted for rotation and its opposite ends are retained in brackets 20, 20 which are movable in a longitudinal direction as indicated by double-headed directional arrow 22.

Belts 16, 16 carry articles, not shown, in the direction indicated by single-headed directional arrow 17. For discussion purposes, this direction is considered to be the first or longitudinal direction.

Figure 8:
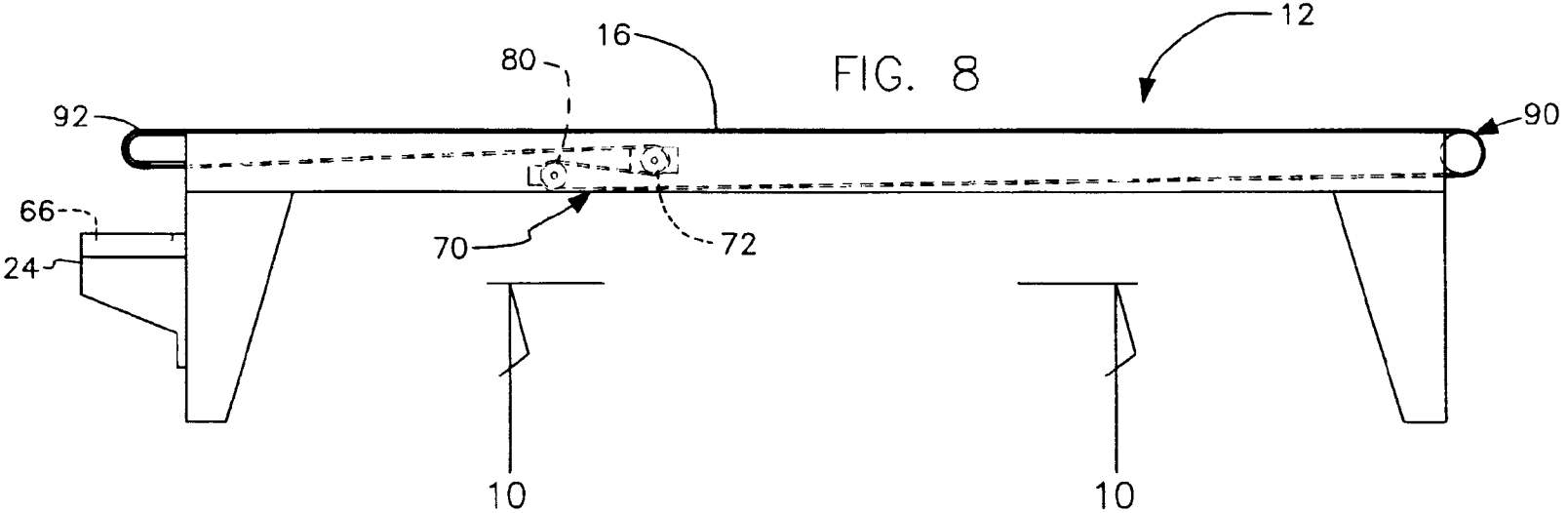
FIG. 8 is a first side elevational view of the novel conveyor system when in its extended mode.
Figure 9:
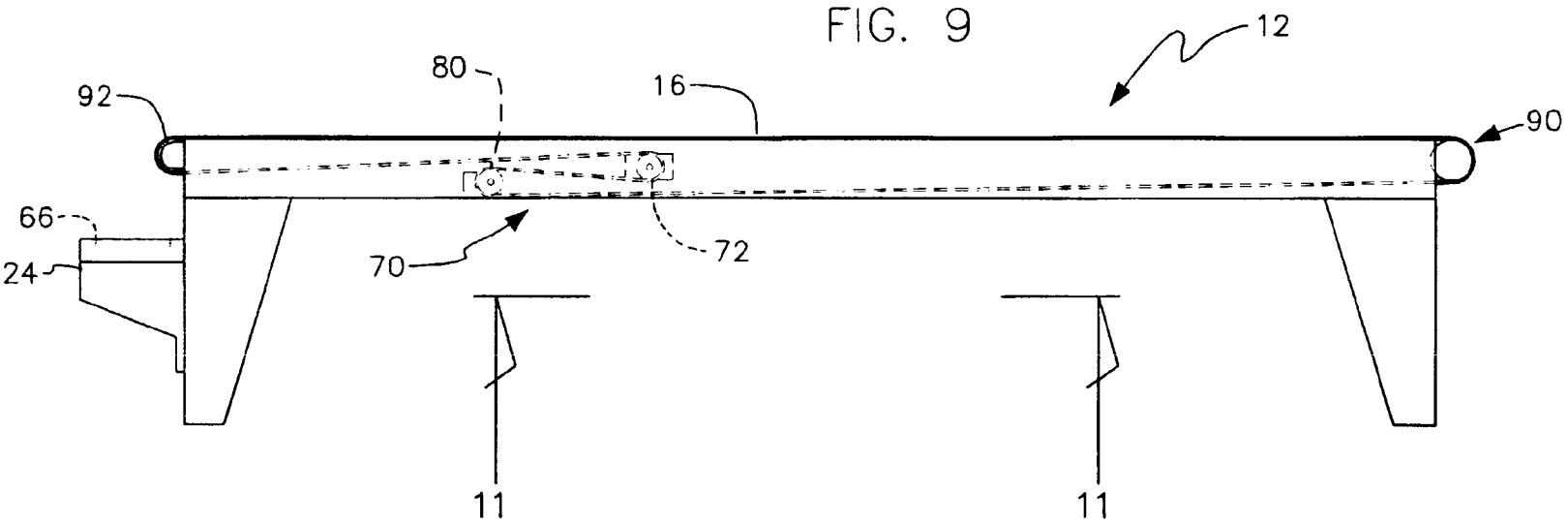
FIG. 9 is a second side elevational view of the novel conveyor system when in its retracted mode.

Support table 24 is depicted in FIGS. 8 and 9. It is positioned at the leading end of conveyor means 12 but it lies in a horizontal plane spaced downwardly from the horizontal plane of conveyor means 12.

Feeder 26 is rotatably mounted atop support table 24. In a first position, depicted in FIG. 1, feeder 26 is positioned with respect to conveyor means 12 so that articles carried by said conveyor means in the direction indicated by directional arrow 17 are carried away from conveyor means 12 by feeder 26 along a first path of travel that is in line with longitudinal path of travel 17 defined by said conveyor means. Thus, there is no change in the direction of travel of said articles when feeder 26 is in its FIG. 1 position.

In FIG. 2, feeder 26 is positioned with respect to conveyor means 12 so that articles carried by said conveyor means are carried away from conveyor means 12 along a second path of travel denoted by single-headed directional arrow 19 that is at a right angle to path of travel 17 defined by said conveyor means. Second path of travel 19 is transverse to first path of travel 17.

Feeder 26 is generally square in configuration as depicted. In FIG. 1, articles being carried along path of travel 17 exit belts 16, 16 and encounter first barrier 28 so that said articles drop onto belts 30. Said belts 30 are rotating in the same direction as belts 16 so the articles are propelled by belts 30 to belts 32 and hence through feeder 26 without changing direction.

Motor 34 rotates driving shaft 36 and hence driven shaft 38, said driven shaft being connected to said driving shaft for conjoint rotation therewith by means of belts and pulleys collectively denoted 40.

Second barrier 42 is adjustable along the length of first barrier 28. Handle 44 is manipulated to enable sliding travel of second barrier 42 along the length of first barrier 28 and said handle is locked when second barrier 42 is in a preselected operable position. The position of second barrier 42 is a function of the size of the articles, not shown, being transported by conveyor means 12.

It should also be observed in FIG. 1 that the area bounded by roller 18, first barrier 28 and second barrier 42 would be made smaller by advancing roller 18 in the direction indicated by directional arrow 17. Such forward movement of said roller could be advantageous where a second plurality of smaller envelopes were to follow a first plurality of larger envelopes, for example.

The bounded area may be thought of as a hopper means because envelopes or other articles accumulate in said bounded area as they await engagement by rollers 32 that discharge them from said bounded area.

FIG. 2 depicts feeder 26 when it is re-configured to discharge articles along path of travel 19 that is at a right angle to original path of travel 17. Note that second barrier means 42 now performs the function performed by first barrier means 28 in the FIG. 1 configuration. The size of the area into which the unillustrated articles are deposited by conveyor means 12 may thus be adjusted by movement of said second barrier 42 along the extent of first barrier 28 and by advancing roller 18 from its illustrated position into said area. Again, the size of said area is adjusted as required by the size of the articles being deposited into feeder 26.

Reference numeral 39 denotes a photoelectric eye mounted at the free end of arm 41 the length of which is adjustable by loosening and tightening set screw 43. Cord 39 a supplies power to photoelectric eye 39. A "Stop" signal from photoelectric eye 39 stops conveyor belts 16, 16 when a stack of articles, such as envelopes, not shown, reaches a predetermined maximum height in the hopper area of feeder 26. Feeder 26 continues to operate during such stoppage, thereby reducing the height of said articles. Such height reduction causes a "Start" signal to be generated by photoelectric eye.39 to re-start said conveyor belts 16,16 when the height of the stack reaches a predetermined minimum height.

Figure 4:
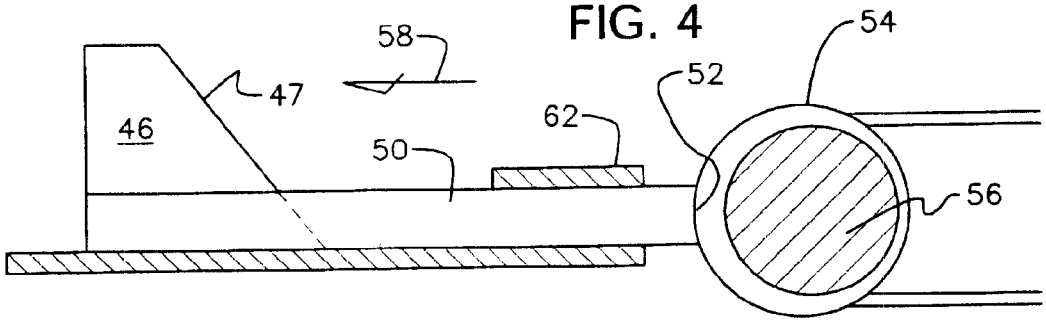
FIG. 4 is a sectional view taken along line 4—4 in FIG. 3.
Figure 5:
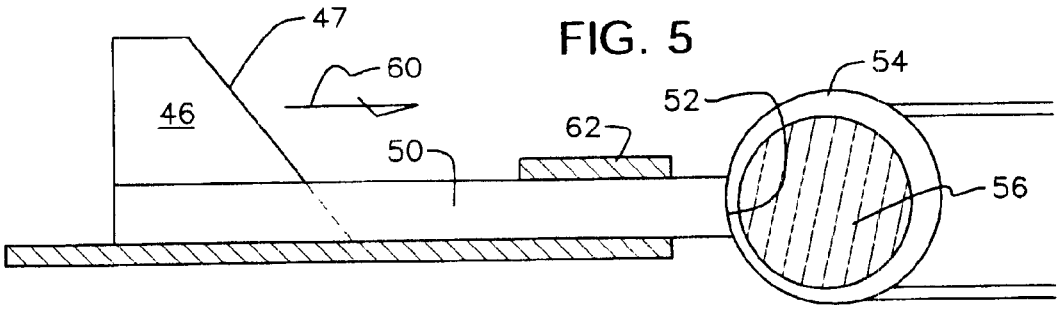
FIG. 5 is a view like FIG. 4 but depicting the parts in a displaced position relative to their FIG. 4 position.

Since the articles must pass through feeder 26 one at a time, they must be properly shingled as they exit conveyor 12 and fall into the hopper means of feeder 26 in a waterfall fashion. The term "waterfall" is best understood by making reference to U.S. Pat. No. 6,164,046 to the present inventor which is hereby incorporated by reference into this disclosure. As best understood by comparing FIGS. 1 and 2 with the enlarged view of FIG. 3 and the sectional views of FIGS. 4 and 5, this invention includes a vibrating means that ensures that the envelopes or other articles that proceed by said waterfall into feeder 26 are properly shingled in a uniform and aligned spacing relative to one another.

The vibrating means includes a pair of upstanding rigid walls 46, 48 each of which has an inclined edge 47, 49. As articles are deposited into feeder 26, the respective trailing edges of said articles land atop said inclined edges 47, 49. Walls 46, 48 are secured at their respective lower ends to bearing rod 50 that has a concave leading end 52 adapted to bear against sleeve 54. Said sleeve is eccentrically mounted to rod 56 so that Walls 46, 48 are alternately displaced in the direction indicated by single-headed directional arrow 58 in FIG. 4 and in the direction indicated by single-headed directional arrow 60 in FIG. 5 as rod 56 rotates. A suitable bias means, not illustrated, urges bearing rod 50 to bear against sleeve 54 on a continuous basis so that walls 46, 48 and hence inclined edges 49, 49 reciprocate whenever feeder 26 is running. Rod 56 upon which sleeve 54 is eccentrically mounted is driven by belts 30, 30.

The reciprocation indicated by said single-headed directional arrows 58, 60 causes the articles to enter into a shingled relation where no edges of any article protrude in a manner that could cause jamming of feeder 26. In the absence of walls 46, 48 and the associated means for causing them to reciprocate, feeder 26 jams frequently.

Elongate restraint member 62 is immovably mounted at its opposite ends to an outer frame of feeder 26 and performs the function of constraining bearing rod 50 in a horizontal plane as it reciprocates so that said bearing rod 50 does not disengage from sleeve 54.

Figure 6:
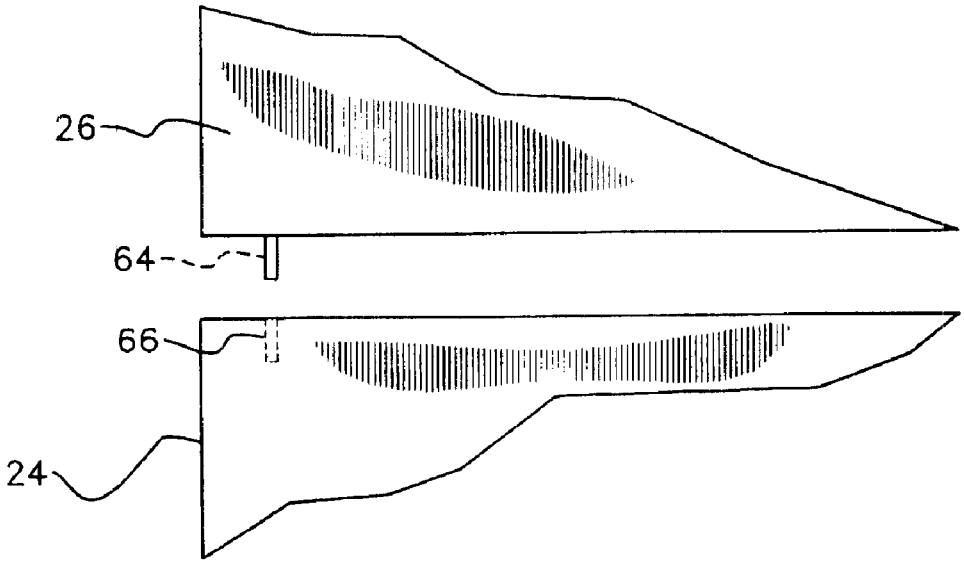
FIG. 6 is an end view taken along line 6—6 in FIG. 1.
Figure 7:
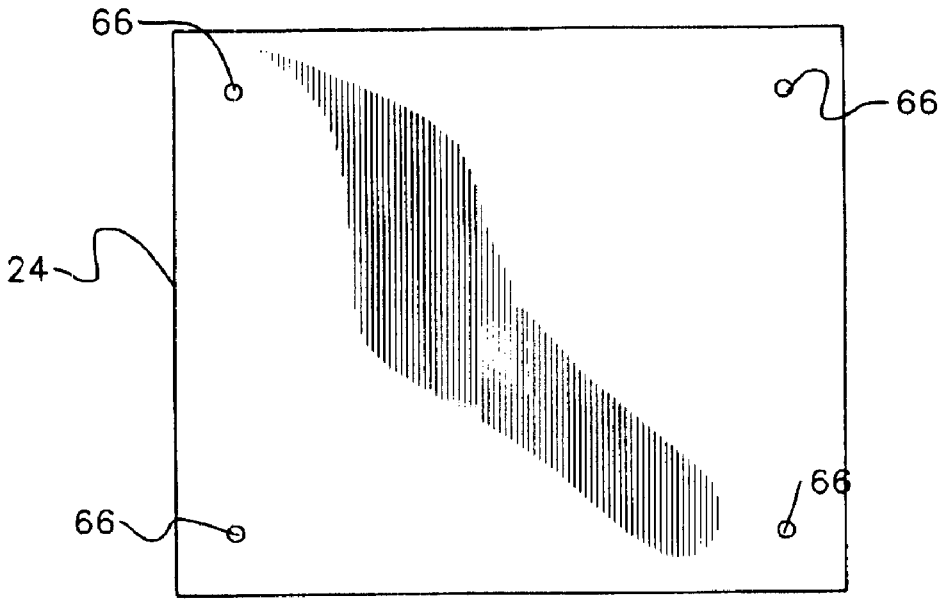
FIG. 7 is a top plan view of the base upon which the feeder is mounted.

There are numerous means for mounting redirecting feeder 26 so that it can be moved between the configurations of FIGS. 1 and 2 in a short time. For example, as depicted in FIGS. 6 and 7, a peg 64 could depend from each of the four corners of feeder 26 and peg-receiving bores, formed in support table 24 (see FIGS. 8 and 9) and collectively denoted 66 in FIG. 7, could receive each of said pegs 64. Accordingly, feeder 26 is simply lifted from support table 24, rotated ninety degrees (90°), and returned to said support table with pegs 64 entering their appropriate bores 66.

The time required to re-position feeder 26 is nominal.

Figure 10:
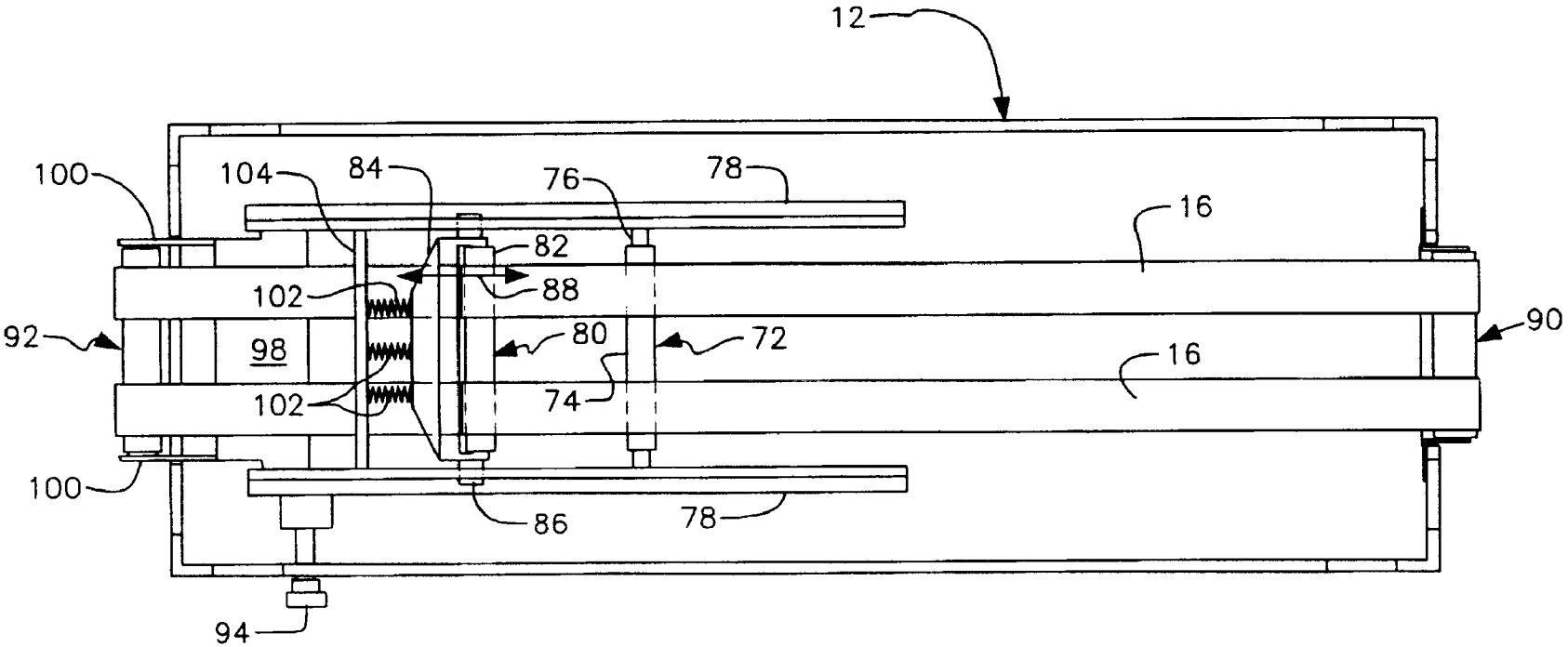
FIG. 10 is a view taken along line 10—10 in FIG. 8.
Figure 11:
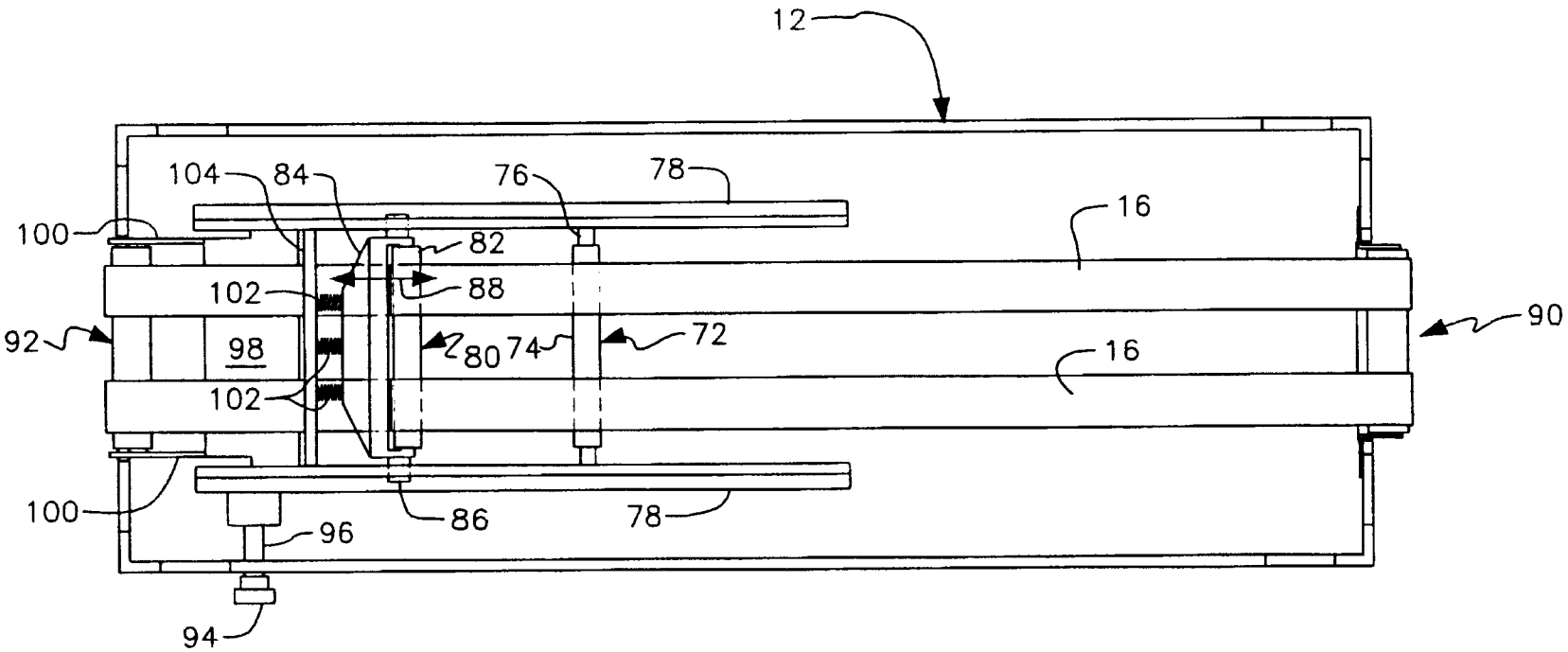
FIG. 11 is a view taken along line 11—11 in FIG. 9.

Referring now to the side elevational views of FIGS. 8 and 9, together with the bottom plan views of FIGS. 10 and 11, it will there be seen that the reference numeral 70 generally denotes the means for extending and retracting belts 16, 16 of conveyor means 12.

A primary roller assembly, denoted 72 as a whole, includes primary roller 74 that is mounted for rotation on primary axle 76. The opposite ends of primary axle 76 are mounted in tracks 78, 78.

A secondary roller assembly is denoted 80 as a whole. It includes secondary roller 82 having its opposite ends rotatably held by movable base 84. Secondary axle 86 carries movable base 84 and the opposite ends of secondary axle 86 are movably mounted in tracks 78, 78.

Double-headed directional arrow 88 indicates that secondary roller assembly 80 is movably mounted. The first, fully extended position of secondary roller assembly 80 is depicted in FIGS. 8 and 10. The second, fully retracted position thereof is depicted in FIGS. 9 and 11. Secondary roller assembly 80 may also be mounted in any position between the fully extended and fully retracted positions.

Conveyor belts 16, 16 wrap around primary roller 74 and secondary roller 80. As best understood in connection with FIG. 8, belts 16, 16 are in their extended configuration when secondary roller assembly 80 is in its retracted configuration, and belts 16, 16 are in their retracted configuration when secondary roller assembly 80 is in its extended configuration.

The respective trailing ends of conveyor belts 16, 16 are wrapped around trailing roller assembly 90 and the respective leading ends of conveyor belts 16, 16 are wrapped around leading roller assembly 92.

The means for displacing secondary roller assembly 80 is best understood in connection with FIGS. 10 and 11. Manually-grippable control knob 94 is rotated counterclockwise to extend leading roller assembly 92 and clockwise to retract said assembly. There are numerous mechanical gear arrangements or linkages that may be designed to connect control knob 94 to leading roller assembly 92, and all of such designs are within the scope of this invention. One way to accomplish the desired movement of said leading roller assembly is to mount control knob 94 onto a first end of control shaft 96 as depicted and to mount a pinion gear, not shown, onto a second end of said control shaft. A rack gear could then be mounted to plate 98 to which leading roller assembly 92 is connected by rigid arms 100, 100 so that rotation of said control knob effects the desired movement of said leading roller assembly.

As mentioned above, extension of belts 16, 16 causes retraction of secondary roller assembly 80. Note in FIG. 10 that a plurality of springs, collectively denoted 102, have their collective leading ends secured to transversely disposed anchor bar 104 that is fixedly secured at its opposite ends to tracks 78, 78 so that it cannot move. Accordingly, as secondary roller assembly 80 is retracted into its FIGS. 8 and 10 position in response to the extension of leading roller assembly 92, springs 102 are extended under tension. Springs 102 therefore provide a bias that pulls secondary roller assembly 80 back into its FIGS. 9 and 11 extended position when leading roller assembly 92 is retracted. Springs 102, or other suitable bias means, thus take up the slack in belts 16, 16 when leading roller assembly is displaced from its extended position to its retracted position or any other position of functional adjustment therebetween.

The ability to adjust the length of belts 16, 16 thus enables high capacity bulk feeder 26 to accommodate articles of varying sizes or articles of the same sizes in differing orientations (such as envelopes of the same size grouped into transversely disposed or longitudinally disposed groupings as may be dictated by printing or other requirements). Coupled with the novel vibrating means that ensures proper shingling of all articles before they are grabbed by the rollers of the feeder, the belt-length adjustment means enables feeder 26 to be used to its highest capacity when in its straight through or ninety degree turn configuration.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An apparatus for vibrating a feeder, comprising:

a vibration means mounted to said feeder for vibrating articles as said articles are deposited into said feeder by a conveyor means, said vibrating means positioning said articles into shingled relation to one another to facilitate one-at-a-time handling of said articles by said feeder;

said vibrating means including a pair of spaced apart upstanding rigid wall members, each of which has an inclined edge adapted to abut trailing ends of said articles as they enter into said feeder;

said vibrating means adapted to cause said pair of rigid wall members to reciprocate over a short range of movement so that said articles are positioned into said shingled relation to one another by said vibration;

said rigid wall members mounted to a first end of a rod that is biased so that a second end of said rod slidingly bears against a rotating cylinder eccentrically mounted on a rotating shaft that rotates when said feeder is operating so that the amount of eccentricity determines the range of the reciprocating motion of said rigid wall members.

2. The apparatus of claim 1, further comprising:

said elongate restraint member disposed in overlying relation to said rod to prevent said rod from disengaging from said rotating cylinder;

an elongate restraint member having opposite ends secured to said feeder to hold said rod against movement in a horizontal plane.

3. The apparatus of claim 2, further comprising:

said conveyor means having a longitudinal path of travel;

said elongate restraint member being disposed transversely to said longitudinal path of travel of said conveyor means.

* * * * *